United States Patent [19]

Turner

[11] 4,406,495

[45] Sep. 27, 1983

[54] FOLDABLE BENCH ASSEMBLY

[76] Inventor: Clifton E. Turner, Rte. 1, Box 140, Clear Spring, Md. 21722

[21] Appl. No.: 244,425

[22] Filed: Mar. 16, 1981

[51] Int. Cl.[3] ..... A47B 39/00

[52] U.S. Cl. ..... 297/135; 297/140; 297/143; 312/235 R

[58] Field of Search ..... 297/143, 142, 141, 140, 297/14, 135; 312/235 R

[56] References Cited

U.S. PATENT DOCUMENTS

| | | | |
|---|---|---|---|
| 1,043,450 | 11/1912 | Morse | 297/141 |
| 1,185,799 | 6/1916 | Doolittle . | |
| 1,339,232 | 5/1920 | St. John et al. | 297/141 |
| 1,590,674 | 6/1926 | Cummings . | |
| 1,597,036 | 8/1926 | Harris et al. . | |
| 1,642,633 | 9/1927 | Vittengl et al. . | |
| 1,668,213 | 5/1928 | Landine | 297/14 X |
| 1,771,231 | 7/1930 | Parkinson . | |
| 2,075,350 | 3/1937 | Leverone | 312/235 R |
| 2,824,598 | 2/1958 | Ertl | 297/143 |
| 3,481,429 | 12/1969 | Gaede | 312/235 R |

*Primary Examiner*—James T. McCall

[57] ABSTRACT

A foldable bench assembly for attaching to a portable structure within a room is provided. The bench assembly includes a seat cushion, a seat platform, legs and at least two telescopable tubes. One end of the telescopable tubes is rotatably attached to the portable structure. The other end of the telescopable tubes is attached to the seat platform such that the seat platform can rotate around an axis in the same plane as the centerline of said telescopable tube. The legs are swingably attached to the seat platform. The seat cushion is attached to the top of the seat platform. A bracket is attached to the portable structure for the tubes to rest on when the bench assembly is in the down position. The bracket may have a pin protruding therefrom which engages holes in the tubes to prevent the tubes from sliding with respect to each other when the bench assembly is in the down position. The bench assembly is folded up by swinging the legs under the seat platform, rotating the seat platform, seat cushion and legs from a horizontal position to a vertical position, and swinging the aforesaid up alongside the portable structure in an arc having as its center of rotation the point of attachment of the telescopable tubes to the portable structure. A clamping device may be attached to the portable structure to engage the bench assembly and hold it in the up position. To place the bench assembly back in the down position, the above steps are repeated in reverse order.

12 Claims, 10 Drawing Figures

FOLDABLE BENCH ASSEMBLY

This invention relates to foldable bench assemblies. In particular, this invention relates to bench assemblies which are attached to a structure and which can be folded up alongside the structure.

BACKGROUND OF THE INVENTION

Frequently when one is in a situation in a work or home environment wherein one desires to find a place to sit while one is working or performing other tasks, such a place is not available within the environment. An example of such a situation is in a vehicle repair garage when a repairman is doing some work on a part of a vehicle such as a carborator, after removing the part from the vehicle. The repairman wants to sit down so that he can be more steady and comfortable while performing the work. Moreover, the repairman may want to sit on a bench for periodic breaks to rest his legs and during lunch and coffee breaks. Most work areas of this type do not have such a bench. Furthermore, even if a bench is provided, it will often be removed from the work area without permission for other purposes and be missing when the repair person wants to use it.

This situation is not unique to the vehicle repair garage environment. Indeed, there are many other environments in which this factual situation occurs (e.g. a filing area of a company, a laboratory, etc.). This invention could be readily employed in these environments as well as the vehicle repair garage. Even though this application describes in detail the employment of this invention in the vehicle repair environment, this description is for the purposes of illustrating the invention and does not serve as a limitation on the invention.

If benches are provided in such an environment as described above, one method of solving the problem of unauthorized removal of these benches is to fixably attach the benches, chairs, etc. to a permanent fixture in the environment. However, while this does provide a place to sit that cannot be easily removed from the work area, the bench, chair, etc. will be a permanent obstacle in the way of people, vehicles, equipment, etc. moving throughout the work area, thus hindering the work undertaken in the work area. It also limits the rearranging of devices and apparatus within the work area.

To the best of my knowledge, there is not currently on the market a bench or chair assembly which is readily available for use in the environments as described above, but which cannot be easily removed from the environment even though the bench or chair assembly is not attached to a permanent fixture of the environment.

It is apparent from the above that there exists a need in the art for a bench or chair assembly that can be readily available for use in an environment such as a vehicle repair garage, can be moved out of the way when not is use, but which cannot be easily removed from the work area. It is the purpose of this invention to fulfill this need and other needs apparent to the skilled artisan once given the following disclosure.

SUMMARY OF THE INVENTION

Generally speaking this invention provides a bench assembly which is attachable to the side of a structure and which can be folded up to be alongside said structure, said bench assembly comprising a bench including a seat platform, legs, said legs being rotatably attached to said platform such that the legs can be folded under the seat platform, tubing, a first end of said tubing being attached to said seat platform, first means for pivotally attaching the second end of said tubing to said structure, and second means attached to said structure for supporting said tubing, said tubing being rotatable about said first means to enable the seat platform to move from a first position in which it acts as a seat for a person to a second folded storage position closely adjacent to the structure, said assembly providing a position for the seat platform parallel to a side of the structure when the tubing is in said second storage position.

In certain embodiments of this invention, the tubing is comprised of first and second telescoping tubes which are also rotatable with respect to each other. Thus, when said seat platform is rotated, one of the tubes will rotate with respect to the other, the other remaining stationary.

In other embodiments of the invention, the first and second bracket means are attached to the same side panel of the portable structure but are spaced horizontally from each other. The first bracket means can be attached near a lower corner of said side panel, while the second bracket means can be attached near the opposite side of the side panel, higher than the first bracket means if desired.

The bench assembly according to this invention has two stable positions, a down or sitting position, and an up position. When the bench assembly is in the down position, the telescopable tubes rest on the second bracket means. In addition, the second bracket means may have a pin protruding from the top thereof which engages holes in the tubing to prevent the tubing from telescoping when the bench assembly is being sat on.

The bench assembly is moved from the down to the up position by first rotating the legs under the seat platform, then rotating the seat platform around a horizontal axis in the same vertical plane as the tubing to a vertical position, and then swinging the bench assembly around said first bracket means alongside the portable structure. When it is desired to move the bench assembly back to the sitting position, the above steps are repeated in a reverse order.

A clamping means may be provided to hold the bench assembly in the up position. The clamping assembly may engage any element of the assembly, however it may be easiest for the clamping means to engage either the legs or the tubing.

This invention will be described with respect to certain embodiments thereof as illustrated in the figures wherein.

DETAILED DESCRIPTION OF THE DRAWING

Figures 1, 2, 3, 4, 5, 6, 7, 8, 9, 10:
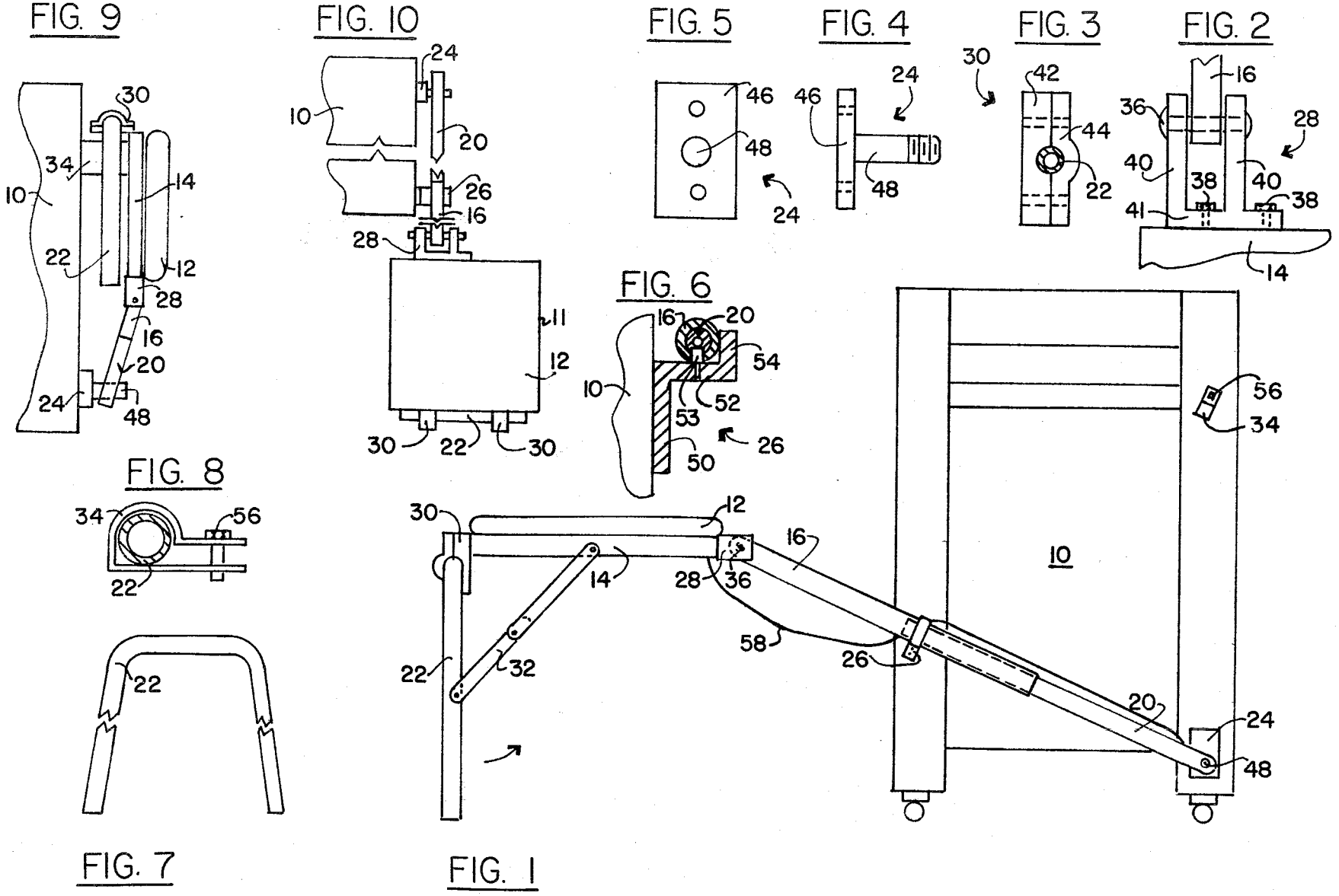
FIG. 1 is a side view of one embodiment of this invention, attached to a tool chest of drawers.
FIG. 2 is a top view of an upper tube bracket which can be employed in the practice of this invention to attach the telescopable tubes to the seat platform.
FIG. 3 is a side view of a leg bracket which can be employed in the practice of this invention, to attach the legs to the seat platform, this Figure also illustrates the crossection of a leg within the leg bracket.
FIG. 4 is a side view of a lower tube bracket which can be employed in the practice of this invention to attach the telescopable tube to the tool chest.
FIG. 5 is a front view of the lower tube bracket illustrated in FIG. 4.
FIG. 6 is a side view of a rest bracket which can be employed in the practice of this invention to support the tubes of this invention when the bench is in the down position, and illustrates tubes resting on the rest bracket.
FIG. 7 is a front view of bench legs which can be employed in the practice of this invention.
FIG. 8 is a side view of a tube clamp which can be employed in the practice of this invention to hold the bench assembly in the up position.
FIG. 9 is a front view of the embodiment of this invention and tool chest illustrated in FIG. 1 showing the bench assembly in the up position.
FIG. 10 is a top view of the embodiment of this invention and tool chest illustrated in FIG. 1 showing the bench assembly in the down position.

Referring to the Figures, and in particular FIG. 1, the embodiment of this invention depicted includes seat cushion 12, seat platform 14, telescopable tubes 16 and 20 and legs 22 attached to a portable structure (i.e. tool chest of drawers 10). Telescopable tube 20 is rotatably attached on one end to tool chest 10 by lower tube bracket 24. Lower tube bracket 24 is comprised on back plate 46 and rod 48. Back plate 46 is attached to a side face of tool chest 10 by bolts (not shown) or by any other conventional attachment means. Rod 48 extends outward from back plate 46 perpendicular to back plate 46, and thus perpendicular to the side face of tool chest 10. Tube 20 has holes therein which are inserted onto rod 48. Rod 48 has a threaded portion on the end thereof on which a bolt is placed to keep tube 20 from sliding off rod 48. This arrangement of elements allows tube 20 to freely rotate on rod 48.

Telescopable tube 16 is attached on one end to seat platform 14 by upper tube bracket 28. Upper tube bracket 28 has back plate 41 which is fixably attached to seat platform 14 by bolts 38. Upper tube bracket 28 also has two flanges 40 which extend outward from and perpendicular to back plate 41. Tube 16 and flanges 40 have holes therein through which bolt assembly 36 is passed to rotatably connect tube 16 to flanges 40.

Tube 20 has a smaller diameter than tube 16 so that the unattached end of tube 20 will fit into the unattached end of tube 16 and slides on the inside of tube 16. Tubes 16 and 20 are also free to rotate with respect to each other.

Safety cable 58 (shown only in FIG. 1) is provided so that tube 20 cannot be accidentally pulled out from tube 16. In the embodiment illustrated in FIG. 1 safety cable 58 is attached to seat platform 14 at one end and at the other end to lower tube bracket 24. In the alternative, the ends of safety cable 58 can be attached to upper tube bracket 28, two chest 10, or to tubes 16 and 20 themselves instead of seat platform 14 and lower tube bracket 24 is desired. The only requirement is that the cable prevent tubes 16 and 20 from coming apart even if safety cable 58 is pulled taut. In lieu of safety cable 58, or in addition to, as on additional safety measure, the ends of tubes 16 and 20 can be flared to prevent them from coming apart.

Seat platform 14 can either be a frame or a solid sheet of material. Seat cushion 12 is fixably attached to the top of seat platform 14.

Legs 22 are attached to seat platform 14 by leg bracket 30. Leg bracket 30 is fixedly attached to seat platform 14 and is comprised of two bracket halves 42 and 44. Bracket halves 42 and 44 have semicircular indentations therein which receive legs 22 such that legs 22 can be freely rotated in these indentations.

Locking brace 32 extends between legs 22 and seat platform 14 and is designed to be in the "lock" position when legs 22 are in the position illustrated in FIG. 1.

This invention also includes rest bracket 26 which is attached to the same side of tool chest 10 as lower tube bracket 24 at a location forward and slightly upward from lower tube bracket 24. Rest bracket 26, in the embodiment illustrated in the Figures, consists of back flange 50, horizontal portion 52 and top flange 54. Back flange 50 abuts tool chest 10 and is attached thereto. Tubes 16 and 20 rest on horizontal portion 52 when the bench is in the "sit" position. Horizontal portion 52 has rod 53 protruding upward therefrom (see FIG. 6) which engages holes in tubes 16 and 20 when tubes 16 and 20 are resting on horizontal portion 52. This safety measure prevents tubes 16 and 20 from telescoping with respect to each other when the bench assembly is being sat on. Top flange 54 acts as a restrain on tubes 16 and 20 to prevent them from sliding off the edge horizontal portion 52 when tubes 16 and 20 are not engaging rod 53. In other words, when the bench is placed in the "sit" position tubes 16 and 20 rest on horizontal portion 52 engaging rod 53 between flange 54 and the adjacent portion of tool chest 10 as shown in FIG. 6.

An optional feature of this invention illustrated in the Figures is clamp 34. As shown in FIG. 1, clamp 34 is attached to the side of tool chest 10 above lower tube bracket 24 and is designed to "lock" the bench assembly in the up position when the bench is not in use. As shown in FIG. 8 clamp 34 has a semi-circular portion which defines a space within which legs 22 are received. Bolt 56 is then tightened to lock legs 22 within this space. Clamp 34 is only one of the many clamping devices that can be used in the practice of this invention. Furthermore, the clamping device employed need not engage legs 22 but can engage any element of the bench assembly in a manner which will hold the bench assembly in the up position. For example, clamp 35 could be located further down tool chest 10, closer to lower tube bracket 24, and be designed to engage either tube 16 or tube 20.

The embodiment of this invention illustrated in the Figures is employed and operated as follows. The bench assembly has two positions; an up or rest position as shown in FIG. 8 wherein the bench assembly is folded up alongside the side of tool chest 10 out of the way of the space in front of tool chest 10; and a down or sit position as illustrated in FIGS. 1 and 10 wherein the bench extends forward of tool chest 10 and is available for someone to sit on. The bench is moved from the sit (or down) position to the rest (or up) position as follows.

First, lock brace 32 is unlatched so that legs 22 are free to rotate. Then, legs 22 are folded under seat platform 14 by swinging them in the direction of the arrow in FIG. 1, legs 22 rotating within leg bracket 30. Next, seat cushion 12 and seat platform 14 (and thus legs 22) are rotated around a horizontal axis such that edge 11 (see FIG. 10) is rotated downward until it is parallel to the floor. Tube 16 is rotating with respect to tube 20 during this movement. Then, seat cushion 12, seat platform 14 and legs 22 are lifted in an arc having rod 48 as the center of rotation. During this rotation it is necessary (with this embodiment) to exert a force along the axis of tubes 16 and 20 so that the distance between tube upper bracket 28 and lower tube bracket 24 is descreased. This is desirable so that the bench assembly does not extend above tool chest 10 when the bench assembly is in the up position. Lastly, legs 22 are placed within clamp 34 and bolt 56 is tightened to hold the entire bench assembly in the up position.

When it is desired to use the bench again, the steps described above are repeated in a reverse order.

The bench can, of course, be designed to be attached to either the right or left side of a structure simply by switching the point of attachment of upper tube bracket 28 to seat platform 14. Also, seat cushion 12 and seat platform 14 can be of any shape or size.

Once given the above disclosure of this invention, other embodiments, modifications, and improvements will become apparent to the skilled artisan. These embodiments, modifications and improvements are considered to be within the scope of this invention as defined by the following claims.

I claim:

1. A bench assembly which is attachable to the side of a structure and which can be folded up to be alongside said structure, said bench assembly comprising:

a bench including a seat platform, legs, said legs being rotatably attached to said platform such that the legs can be folded under the seat platform, tubing, a first end of said tubing being attached to said seat platform, first means for pivotally attaching the second end of said tubing to said structure, and second means attached to said structure for supporting said tubing, said tubing being rotatable about said first means to enable the seat platform to move from a first position in which it acts as a seat for a person to a second folded storage position closely adjacent to the structure, said assembly providing a position for the seat platform parallel to a side of the structure when the tubing is in said second storage position, said tubing being comprised of at least a first and a second tube, said tubes being telescopable and rotatable with respect to each other, the seat platform being rotatable around an axis which begins at the point of attachment of said tubing to said seat platform and is in the same plane as the centerline of said tubing.

2. A bench assembly according to claim 1 wherein the structure has at least one side panel, and wherein the first means and the second means are attached to said side panel.

3. A bench assembly according to claim 2 wherein said first means is attached near a lower corner of said side panel, and wherein said second means is attached near the other side of said side panel.

4. A bench assembly according to claim 3 wherein said second means is located above said first means.

5. A bench assembly according to claim 4 wherein the bench assembly is designed to be attached to a portable structure.

6. A bench assembly according to claim 5 wherein said tubing is supported by said second means when said bench is in the down position.

7. A bench assembly according to claim 6 wherein said second means has a horizontal section upon which said tubing rests and a vertical section which prevents said tubing from sliding off said horizontal section when said bench is in the down position.

8. A bench assembly according to claim 7 wherein the horizontal section of said second means has a rod protruding from the top thereof which engages holes in said tubing when said bench is in the down position.

9. A bench assembly according to claim 8 further comprising a clamping means for engaging said bench assembly when said bench is in the up position, said clamping means being attached to said side of said portable structure.

10. A bench assembly according to claim 9 wherein said clamping means engages said legs, and wherein said clamping means has a first position which encompasses said legs and a second portion that is tightened to prevent the release of said legs.

11. A bench assembly according to claim 10 further comprising a third means for attaching said second end of said tubing to said seat platform, said third means designed such that one of said tubes rotates with said seat platform when said seat platform is rotated.

12. A foldable bench assembly for attaching to a portable tool chest of drawers comprising:

a bench including a seat platform, legs, said legs being rotatably attached to said platform such that the legs can be folded under the seat platform, tubing, a first end of said tubing being attached to said seat platform, first means for pivotally attaching the second end of said tubing to said chest of drawers, and second means attached to said chest of drawers for supporting said tubing, said tubing being rotatable about said first means to enable the seat platform to move from a first position in which it acts as a seat for a person to a second folded storage position closely adjacent to the chest of drawers, said assembly providing a position for the seat platform parallel to a side of the chest of drawers when the tubing is in said second storage position, said tubing being comprised of at least a first and a second tube, said tubes being telescopable and rotatable with respect to each other, the seat platform being rotatable around an axis which begins at the point of attachment of said tubing to said seat platform and is in the same plane as the centerline of said tubing.

* * * * *